US006880618B2

(12) United States Patent
Goettsch et al.

(10) Patent No.: US 6,880,618 B2
(45) Date of Patent: Apr. 19, 2005

(54) MAKING SUBCUTANEOUS FLOW-CHANNELS IN FOAM PATTERNS

(75) Inventors: David Douglas Goettsch, Shelby Township, MI (US); Bob Ross Powell, Jr., Birmingham, MI (US)

(73) Assignee: General Motors Corporation, Detroit, MI (US)

( * ) Notice: Subject to any disclaimer, the term of this patent is extended or adjusted under 35 U.S.C. 154(b) by 93 days.

(21) Appl. No.: 10/619,667

(22) Filed: Jul. 15, 2003

(65) Prior Publication Data

US 2005/0011625 A1 Jan. 20, 2005

(51) Int. Cl.[7] ..... B22C 9/04

(52) U.S. Cl. ..... 164/516; 164/35; 164/36; 164/45

(58) Field of Search ..... 164/516–519, 164/45, 34–36

(56) References Cited

U.S. PATENT DOCUMENTS 4,651,799 A * 3/1987 Chandley ..... 164/35

6,189,598 B1 * 2/2001 Chandley et al. ..... 164/34

FOREIGN PATENT DOCUMENTS

JP 2-263537 * 10/1990

OTHER PUBLICATIONS

"A metal accelerator method used in the lost foam casting process" *Research Disclosure #445057,* May, 2001.

* cited by examiner

*Primary Examiner*—Kuang Y. Lin
(74) *Attorney, Agent, or Firm*—Kathryn A. Marra

(57) ABSTRACT

Method of making a subcutaneous melt flow-channel in the surface of a fugitive foam pattern used in lost-foam casting process. After a refractory skin has been formed on the surface of a foam pattern, a strip of the skin is treated so as to cause the foam underlying the strip to recede from the strip and leave a groove in its stead. Suitable treatments include (1) heating the strip, or (2) applying a foam solvent thereto that soaks through the skin. In each case, the treatment is such as to cause the foam underlying the treated strip to soften and recede from the strip.

14 Claims, 2 Drawing Sheets

MAKING SUBCUTANEOUS FLOW-CHANNELS IN FOAM PATTERNS

TECHNICAL FIELD

This invention relates to the "Lost-Foam" casting of metals, and more specifically, to a method for forming subcutaneous melt flow-channels in the surfaces of lost-foam patterns.

BACKGROUND OF THE INVENTION

The so-called "lost-foam" casting process is a well-known technique for producing metal castings wherein a fugitive, pyrolizable, polymeric, foam pattern, together with attached gating, runner and sprue systems (hereafter pattern assembly) is covered with a thin (i.e. 0.25–0.5 mm), gas-permeable, refractory (e.g. mica, silica, alumina, alumina-silicate, etc.) coating/skin, and embedded in a granular molding media (e.g. unbonded sand) to form a pattern-filled, mold cavity within the sand. Molten metal (hereafter "melt") is then introduced into the pattern-filled mold cavity to pyrolyze, and displace the pattern assembly with melt. Gaseous and liquid decomposition/pyrolysis products escape through the gas-permeable, refractory skin into the interstices between the unbonded sand particles. The thickness of the refractory skin affects coating permeability, which, in turn, controls the rate at which foam decomposition/pyrolysis products are removed from the mold cavity. Typical fugitive polymeric foam patterns comprise expanded polystyrene foam (EPS) for aluminum castings, and copolymers of polymethylmethacrylate (PMMA) and EPS for iron and steel castings. A particularly effective copolymer for iron and steel comprises, by weight, 70% EPS and 30% PMMA (i.e. 70130 EPS/PMMA).

The polymeric foam pattern is made by injecting pre-expanded polymer beads into a pattern mold to impart the desired shape to the pattern. For example, raw expandable polystyrene (EPS) beads (cα. 0.2 to 0.5 mm in diameter), containing a blowing/expanding agent (e.g. n-pentane), are: (1) first, pre-expanded at a temperature above the softening temperature of polystyrene and the boiling point of the blowing agent; and (2) then, molded into the desired configuration in a steam-heated pattern mold which further expands the beads to fill the pattern mold. Complex patterns and pattern assemblies are made by molding several individual mold segments, and then gluing them together to form the finished pattern/assembly.

The melt may be either gravity-cast (i.e. poured from an overhead ladle or furnace), or countergravity-cast (i.e. forced upwardly by vacuum or low pressure into the mold cavity from an underlying vessel, e.g. a furnace). In gravity-cast lost-foam processes, the hydraulic head of the melt is the driving force for filling the mold cavity with melt. In countergravity-cast lost-foam processes, the driving force for filling the mold cavity is the intensity of the vacuum applied to the mold or the pressure applied to the melt underlying the mold.

Gravity-cast, lost-foam processes are known that: (1) top-fill the mold cavity by pouring the melt into a basin overlying the pattern so that the melt flows downwardly into the mold cavity through a gating system (i.e. one or more gates) located above the pattern; (2) bottom-fill the mold cavity by pouring the melt into a vertical sprue that lies adjacent the pattern and extends from above the mold cavity to the bottom of the mold cavity for filling the mold cavity from beneath through a gating system located beneath the pattern so that the melt flows vertically upwardly into the mold; and (3) side-fill the mold cavity by pouring the melt into a vertical sprue that lies adjacent the pattern and extends from above the mold cavity to the side of the mold cavity for horizontally filling the mold cavity through a gating system located at the side of the pattern.

The casting rate (i.e. the rate at which the metal enters the mold cavity) is limited by the rate the advancing melt front can pyrolyze the pattern and displace it from the cavity. Faster casting rates are desirable because less heat is lost from the melt during the filling process, and shorter production cycle times are possible. Shorter cycle times improve the economics of the process, while less heat loss keeps the melt hotter. Hotter melts reduce the formation of "folds" (i.e. pyrolysis products trapped at the confluence of cold metal fronts) in the casting, as well as cold-shut defects (i.e. metal that does not completely fill the pattern due to premature solidification). Casting rates have heretofore been increased by providing one or more melt flow-channels (a.k.a. "lighteners") that extend from the gating system into the pattern, and through which the melt can rush into the pattern. Such flow-channels/lighteners typically extend into the innards of the pattern along the joints where the individual pattern segments are joined, and are molded into the pattern segments at the time the segments are formed. Such channel-forming techniques have heretofore only been effective with thicker (i.e. ≧8 mm) sections of pattern. Alternatively, the pattern segment may be molded around a narrow rod that is subsequently withdrawn from the segment to form the flow-channel. This technique is limited to forming straight flow-channels without any intervening features (e.g. turns), and hence has limited usefulness.

SUMMARY OF THE INVENTION

The present invention comprehends a method for making patterns for the "lost-foam" casting of molten metal, which patterns contain one or more subcutaneous metal flow-channels formed in the surface of the foam immediately beneath the refractory skin covering the foam. The flow-channels serve to increase the fill rate, and to direct hot melt to the sites where colder melts could form a fold. Alternatively, the flow-channel could direct the melt in such a manner as to relocate the site(s) where melt fronts meet, and thereby position any folds that might occur in regions of the casting where they can do no harm. More specifically, the method comprises forming a fugitive foam pattern into a desired shape having an outer surface, covering the outer surface with a gas-permeable refractory skin, and selectively treating one or more strips (e.g. ≦0.4 mm wide) of the skin to cause the foam immediately underlying the strip to recede from the treated skin and form a subcutaneous melt flow-channel in the surface of the foam. The subcutaneous melt-flow-channel directs and speeds the flow of molten metal along the surface during pouring of the melt and filling of the mold cavity.

According to one embodiment of the invention, the treating comprises heating the strip of refractory skin sufficiently to soften the foam immediately underlying the heated strip and cause it to recede and shrink away from the refractory skin. The heat may be applied to the strip in a number of ways including, for example, contacting the skin with a heated tool (e.g. a hot wire), a laser beam, or a jet of hot gas. According to another embodiment, the treating comprises wetting (e.g. brushing, swabbing, spraying or jetting) the strip of skin with a solvent (e.g. acetone) that softens and causes the foam that underlies the wetted strip to recede and shrink away from the skin. In either embodiment (i.e. heated or solvent-wetted), a temporary mask having a slit therein may be used to confine the treatment zone to selected areas, and to otherwise protect the skin on either side of the strip from the treating medium (i.e. heat, solvent). In general, lost foam castings made from EPS patterns having a subcutaneous flow-channel in accordance with the present invention had melt front velocities 2 to 15 times greater than castings made using unaltered EPS patterns.

BRIEF DESCRIPTION OF THE DRAWINGS

The invention will better be understood when considered in the light of the following detailed description of a specific embodiment thereof which is given hereafter in conjunction with the several drawings in which.

DETAILED DESCRIPTION OF THE INVENTION

Figure 1:
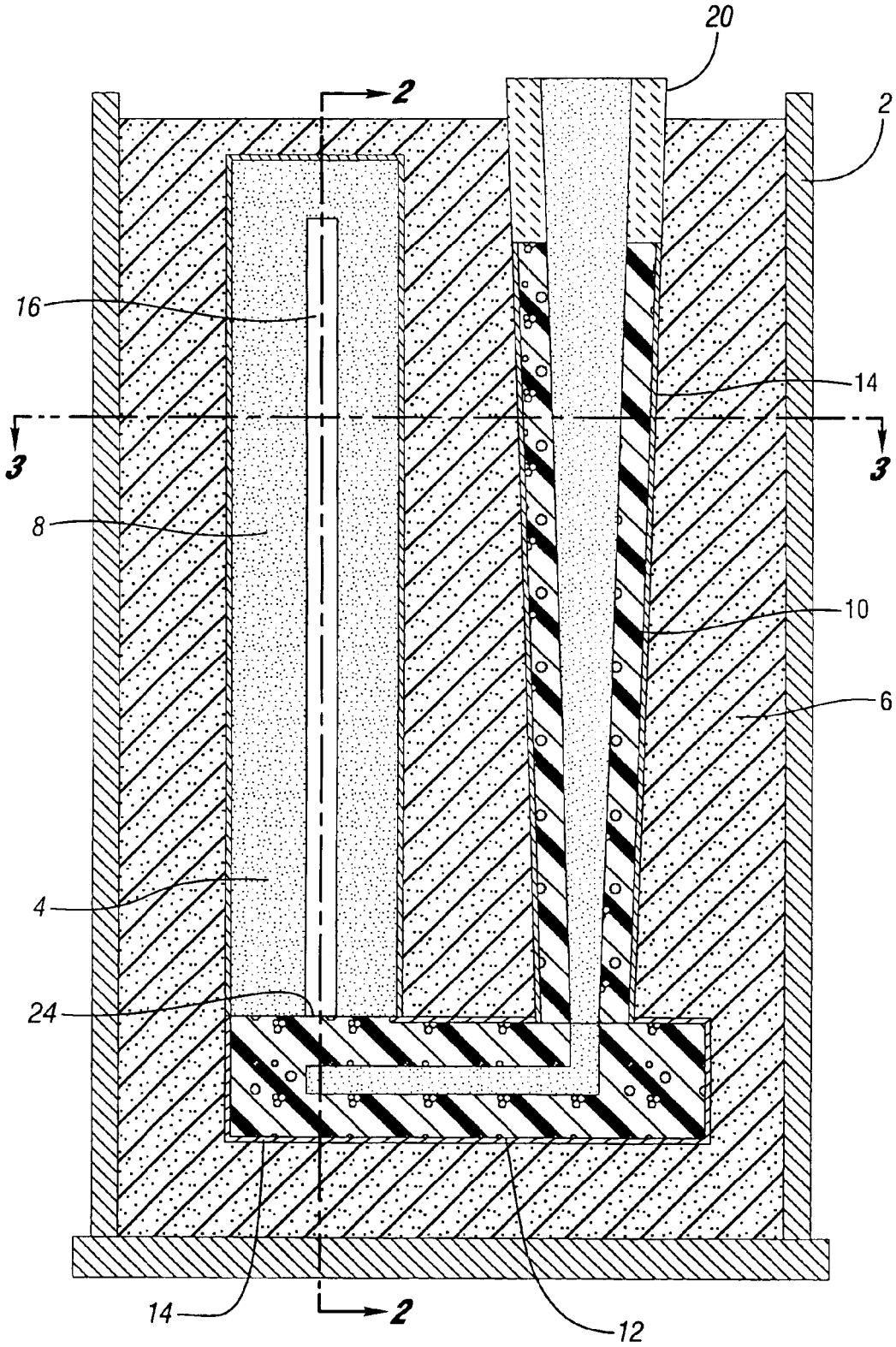
FIG. 1 is a side, sectional view through a Lost-Foam flask taken in the direction 1—1 of FIG. 3.
Figure 2:
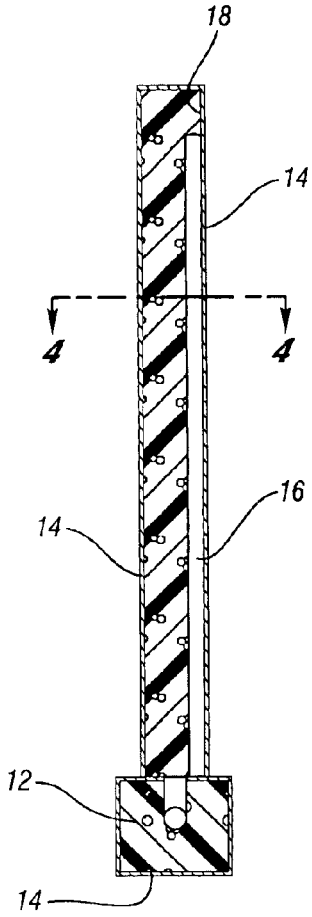
FIG. 2 is a front, sectional view (sans molding media & flask) taken in the direction 2—2 of FIG. 1.
Figure 3:
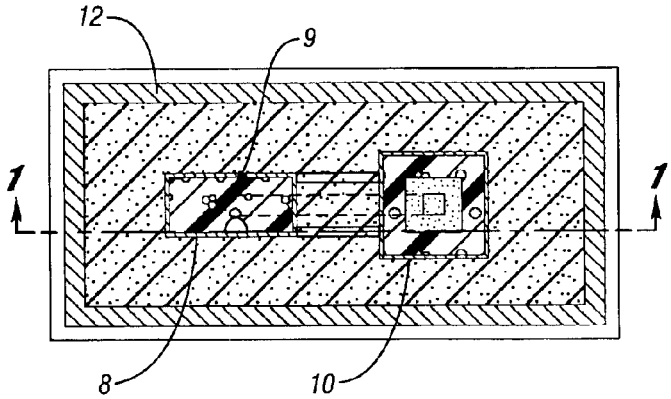
FIG. 3 is a top sectional view (sans molding media) taken in the direction 3—3 of FIG. 1.
Figure 4:
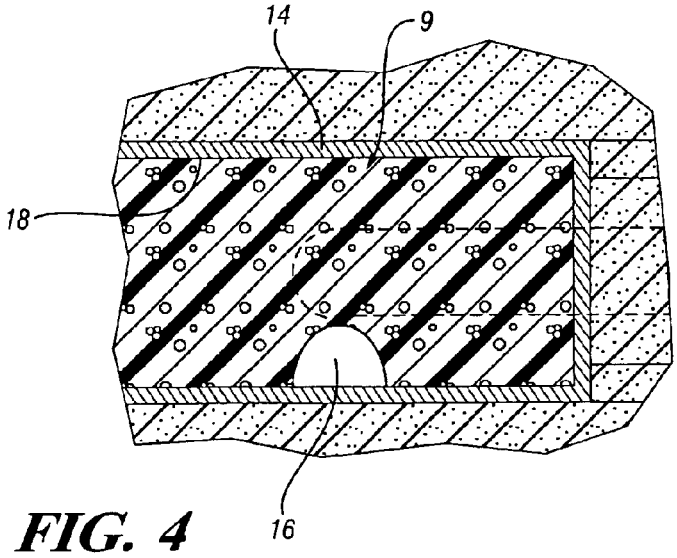
FIG. 4 is an enlarged, top sectional view in the direction 4—4 of FIG. 2.

The several Figures depict a Lost-Foam flask 2 containing a bed of loose sand 6 embedding a fugitive foam pattern assembly 4 therein. The foam pattern assembly 4 includes a pattern 8 for shaping the casting, a hollow downsprue 10, and a runner 12 communicating the bottom of the downsprue 10 with a gate on the underside of the pattern 8. A refractory pouring cup 20 sits atop the downsprue 10 and receives the melt directly from an overhead ladle (not shown).

The pattern assembly 4 comprises a pyrolizeable, fugitive foam (e.g. EPS), that is coated with a thin, (i.e. about 0.25 to about 0.5 mm), gas-permeable, refractory (e.g. mica, alumina, silica, alumino-silicate, etc.) skin 14. In this regard, the pattern assembly 4 is dipped in an aqueous slurry containing the refractory particles, dispersants, thixotropic agents and binders, and then drained and dried. A number of materials and processes for forming such refractory skins are well known to those skilled in the art, and include such commercially available processes as Ashland's Ceramcote™, HA International's Styro Kote™ and HA International's Styro Shield™, inter alia.

In accordance with the present invention, a subcutaneous melt flow-channel 16 is formed beneath the refractory skin 14 for directing and speeding the flow of melt along the surface 18 of the pattern 8. The melt flow-channel 16 is formed by treating a narrow strip of the refractory skin 14 that covers the foam pattern 4 so as to cause the foam immediately underlying the treated strip to shrink and recede away from the treated skin. While only a single flow-channel 16 is depicted in the drawings, it is to be understood that multiple such flow-channels may be provided at other locations on the surface of the pattern 8 to further shorten mold fill time and reduce the formation of folds and cold shut defects in the casting.

According to one embodiment of the invention, sufficient heat is applied to a strip of refractory skin to cause the underlying foam to soften and shrink away from the skin. The heat may be applied to the skin by means of a heated tool that contacts the skin. One such tool is an electrically heated wire that (1) may extend the full length of the entire strip, or (2) may be shorter than the full length, and drawn slowly along the length of the strip. Alternatively, a laser beam (e.g. a $CO_2$ laser), or jet of hot air, directed against the skin may be used in lieu of the heated tool. A temporary mask (e.g. a plate integrated into the heat applicator) having a slit therein may be positioned atop the skin to confine the heat to that area of the skin that confronts the slit. Regardless of the heating means, the strip is heated to a high enough temperature to cause the foam underlying the strip to soften and recede from the heated strip of skin. This softening/receding temperature is at least about 110° C. for EPS foam. At this temperature, 30/70 EPS/PMMA foam will recede at a slower rate than pure EPS. For comparable receding rates, the temperature should be at least about 120° C. for 30/70 EPS/PMMA copolymer foams. At very high temperatures (e.g. 425° C.), both foams act similarly.

According to another embodiment of the invention, a strip of the permeable refractory skin is wetted with sufficient solvent for the foam to soften the foam underlying the strip enough to cause it to recede from the strip and form the subcutaneous flow-channel. Preferably, a narrow jet (ala ink jet printing) of solvent is applied to the refractory skin. Alternatively, the solvent may be sprayed, swabbed or brushed onto the skin. A temporary mask (e.g., a plate integrated into the solvent applicator) having a slit therein may be positioned atop the skin to confine the solvent to that area of the skin that confronts the slit. Suitable EPS solvents include comprise acetone, benzene, carbon tetrachloride, chloroform, cyclohexane, 1,2dichloro methane, dioxane, ethyl acetate, ethyl benzene, pyridine, tetrahydrofuran, toluene and xylene, inter alias, which serve to plasticize the foam and allow it to relax from a stressed state that is induced into the foam during molding. Suitable solvents for PMMA foams are chlorobenzene, tetrahydrofuran, methylisobutylketone, n-butylchloride, 3-heptanone, and 4-heptanone, inter alias.

The allowable width of the flow-channel at the foam surface is determined by the strength of the refractory skin overlying the flow-channel. In this regard if the flow-channel is too wide, the skin overlying the channel can collapse when the sand is compacted about the pattern thereby plugging the flow-channel. For the refractory skins in commercial use today, flow-channel widths of less than about 2 mm are recommended to insure sufficient skin strength to prevent skin collapse during sand compaction. As stronger refractory skins are developed, wider flow-channels will be possible. The depth of the flow-channel is about the same for both techniques (heat and solvent), and is generally about 1 mm to about 4 mm.

Operationally, the refractory coated pattern assembly 4 is suspended in a flask 2 which is vibrated while loose sand 6 is pluviated around the pattern in the flask. The vibration compacts the sand firmly around the pattern assembly 4 without imposing too much pressure thereon. After the sand has been compacted about the assembly, the flask is transported to a pouring station, and molten metal (e.g. aluminum, iron, etc.) poured into the mouth 22 of the refractory pouring cup 20 from whence it flows into the hollow foam downsprue 10. Pyrolysis gases formed by the decomposition of the downsprue's foam bubble upwardly through the hollow in its center as well as move laterally through the refractory skin 14 encasing the downsprue 10. The melt next traverses the hollow foam runner 12 that extends between the downsprue 10 and pattern 8. The melt enters the pattern-filled cavity 9 from beneath and rises therein as the pattern is pyrolyzed and its decomposition products escape through the refractory skin 14 into the sand 6. Upon encountering the bottom 24 of the flow-channel 16, the melt rushes up the flow-channel toward the top of the pattern 8—quickly; at first, and then more slowly as the flow-channel fills with pyrolysis gases that have not yet escaped through the refractory skin. The melt rises in the flow-channel 16 and begins to spread out laterally therefrom as it pyrolizes the foam that surrounds and defines the flow-channel 16. While only a gravity-fed, bottom-filled embodiment has been shown/discussed, it is to be understood that the concepts involved with the present invention are equally applicable to top-filled and side-filled embodiments as well.

EXAMPLES

A number of tests were conducted wherein the rate at which the melt front advanced into top-filled, side-filled, and bottom-filled patterns (with and without the subcutaneous flow-channels of the present invention) were observed using real-time X-ray. EPS foam patterns, in the shape of a paddle (i.e. 32×6×0.8 cm.), were used to test the invention. The paddle was provided with a 0.21 mm thick mica skin (i.e. Ashland 530ff) having a permeability of 5.8 as described in Kocan, Gerald, "Incorporating Permeability into Lost Foam Coating Controls", AFS Transactions, Vol. 104, pp 565–569 (1996). A 0.1 cm deep by 0.2 cm wide by 32 cm long flow-channel was formed beneath the silica skin using an Edsyn 1036 atmoscope hot air jet with an air jet tip having 0.06 cm hole diameter spaced 1 cm from the skin. The air temperature was 425° C., and air pressure about 9 psi. The jet tip traversed the paddle at a rate of 2 cm/sec, and formed a flow-channel that was approximately 0.2 cm wide by 0.1 cm deep. The paddle patterns were placed in a flask, buried in loose sand and displaced with A356 aluminum poured at 750° C.

In the side-filled tests, the metal front had an initial velocity along the flow-channel of 17 cm/sec in the first second following contact with the subcutaneous flow-channel, and thereafter slowed to 10 cm/sec by the end of the second second, and finally to 4 cm/sec. by the end of the third second for an average of 10.3 cm/sec over the 3 second evaluation period which is about ten times the velocity of melt side-filled into an unaltered foam pattern.

In the bottom-filled tests, the metal front had an initial velocity along the flow-channel of 14 cm/sec in the first second following contact with the subcutaneous flow-channel, and thereafter slowed to 6 cm/sec by the end of the second second, and finally 2 cm/sec. by the end of the third second for an average of about 7 cm/sec over the 3 second evaluation period which is about 7 times the velocity of melt bottom-filled into an unaltered foam pattern. The difference in velocity between the side-filled and the bottom-filled pattern is attributable to pyrolysis gases collecting in the flow-channel above the melt front which inhibits melt advance into the flow-channel until the gases can escape through the refractory skin into the sand.

In the top-filled tests, the metal front had an initial velocity along the flow-channel of 10 cm/sec in the first second following contact with the subcutaneous flow-channel, and thereafter slowed to 5 cm/sec by the end of the second second, 6 cm/sec by the end of the third second, and finally 5 cm/sec. by the end of the fourth second for an average of about 6 cm/sec over the 4 second evaluation period which is about 6 times the velocity of melt top-filled into an unaltered foam pattern.

While the invention has been described in terms of certain specific embodiments thereof, it is not intended to be limited thereto, but rather only to the extent set forth hereafter in the claims which follow.

What is claimed is:

1. A method of making a pattern for the lost-foam casting of molten metal comprising forming a fugitive foam pattern into a desired shape having an outer surface, coating said outer surface with a gas-permeable refractory skin, and selectively treating a strip of said skin to cause the foam immediately underlying said strip to recede from said skin and form a subcutaneous flow-channel in said surface beneath said strip for directing and speeding the flow of said molten metal across said surface during said casting.

2. A method according to claim 1 wherein said treating comprises applying sufficient heat to said strip to soften and cause said underlying foam to recede from said skin.

3. A method according to claim 2 wherein said heat is applied by contacting said skin with a heated tool.

4. A method according to claim 2 wherein said heat is applied by directing a laser beam onto said surface.

5. A method according to claim 2 wherein said heat is applied by contacting said skin with a jet of hot gas.

6. A method according to claim 5 wherein said hot gas is air.

7. A method according to claim 1 wherein said treating comprises wetting said strip with sufficient solvent for said foam to soften said underlying foam sufficiently to cause it to recede from said strip and form said subcutaneous flow-channel.

8. A method according to claim 7 wherein said treating comprises directing a narrow jet of said solvent on to said strip.

9. A method according to claim 7 comprising covering said skin with a temporary mask having a slit therein conforming to said strip, and applying said solvent to said strip through said slit.

10. A method according to claim 1 comprising covering said skin with a temporary mask having a slit therein conforming to said strip, and treating said skin through said slit.

11. A method according to claim 7 wherein said foam comprises expanded polystyrene, and said solvent is selected from the group consisting of acetone, benzene, carbon tetrachloride, chloroform, cyclohexane, 1,2dichloro methane, dioxane, ethyl acetate, ethyl benzene, pyridine, tetrahydrofuran, toluene and xylene.

12. A method according to claim 10 wherein said treating comprises applying heat to said strip through said slit, and said mask comprises a thermal shield for thermally insulating such of said skin as lies adjacent said strip from said heat.

13. A method according to claim 7 comprising swabbing said solvent on to said strip.

14. A method according to claim 7 wherein said foam comprises polymethylmethacrylate and said solvent is selected from the group consisting of chlorobenzene, tetrahydrofuran, methylisobutylketone, n-butylchloride, 3-heptanone, and 4-heptanone.

* * * * *